US005387845A

United States Patent [19]

Nilssen

[11] Patent Number: 5,387,845

[45] Date of Patent: Feb. 7, 1995

[54] NEON LAMP POWER SUPPLY

[76] Inventor: Ole K. Nilssen, Caesar Dr., Rte. 5, Barrington, Ill. 60010

[21] Appl. No.: 890,312

[22] Filed: May 26, 1992

Related U.S. Application Data

[63] Continuation of Ser. No. 177,473, Apr. 1, 1988, abandoned.

[51] Int. Cl.[6] ..... H05B 37/02; H05B 39/04; H05B 41/36

[52] U.S. Cl. ..... 315/209 R; 315/241 R; 315/244

[58] Field of Search ..... 315/244, 241 R, 278, 315/280, 91, 209 R, 200 R, 238, 227 R

[56] References Cited

U.S. PATENT DOCUMENTS

| | | | |
|---|---|---|---|
| 1,885,973 | 11/1932 | Wilson | 40/545 |
| 1,943,772 | 1/1934 | Prouty | 40/545 |
| 2,125,009 | 7/1938 | Wolf | 40/545 |
| 2,139,815 | 12/1938 | Fodor | 40/545 |
| 2,683,241 | 7/1954 | Passmore | 315/276 |
| 2,731,585 | 1/1956 | Rousseau | 40/545 |
| 4,463,286 | 7/1984 | Justice | 315/244 |
| 4,524,305 | 6/1985 | Martin | 315/244 |
| 4,608,523 | 8/1986 | Nilssen | 315/244 |
| 4,613,934 | 9/1986 | Pacholok | 315/DIG. 7 |
| 4,626,747 | 12/1986 | Nilssen | 315/209 R |
| 4,629,946 | 12/1986 | Amano et al. | 315/219 |
| 4,675,577 | 6/1987 | Hanlet | 315/70 |
| 4,682,082 | 7/1987 | MacAskill et al. | 315/DIG. 7 |
| 4,698,741 | 10/1987 | Pacholok | 315/DIG. 7 |
| 4,712,170 | 12/1987 | Grace | 315/DIG. 7 |
| 5,053,681 | 10/1991 | Budny et al. | 315/219 |

*Primary Examiner*—Robert J. Pascal
*Assistant Examiner*—Michael B. Shingleton

[57] ABSTRACT

A power-line-operated frequency-converting power supply provides a 30 kHz current-limited AC voltage at an output receptacle. A neon lamp is connected across the secondary winding of a gapped ferrite-type leakage transformer, the primary winding of which is connected with the output receptacle by way of a light-weight cord, thereby permitting the lamp-transformer combination to be located remotely from the power supply. The secondary winding is arranged to have a well defined inductance; which inductance is tuned to resonate at 30 Khz by way of a parallel-connected tuning capacitor. Tightly coupled with the secondary winding is a control winding with which is connected a protection circuit operative to place an auxiliary capacitor across the control winding in case the neon lamp fails to ignite within a few milli-seconds, thereby detuning the secondary winding enough to protect the power supply and the leakage transformer from sustained overload.

22 Claims, 2 Drawing Sheets

NEON LAMP POWER SUPPLY

This application is a continuation of application Ser. No. 07/177,473, filed Apr. 1, 1988 now abandoned.

BACKGROUND OF THE INVENTION

1. Field of the Invention

Broadly, the present invention relates to electronic ballasting means for gas discharge lamps, particularly to ballasting means wherein the lamps are powered by way of series-excited parallel-loaded resonant L-C circuits.

More particularly, the present invention relates to power supplies for neon lamps and signs.

2. Description of Prior Art

There are two predominant types of electronic ballasts for gas discharge lamps: (a) a first type may be referred-to as the parallel-resonant type and involves the use of a current-excited (i.e., parallel-excited) parallel-loaded resonant L-C circuit; and (b) a second type that may be referred-to as the series-resonant type and involves the use of a voltage-excited (i.e., series-excited) parallel-loaded resonant L-C circuit.

An example of the parallel-resonant type of electronic ballasts is described in U.S. Pat. No. 4,277,726 to Burke. An example of the series-resonant type of electronic ballasts is described in U.S. Pat. No. 4,538,095 to Nilssen.

Of these two types of electronic ballasts, the parallel-resonant type is conducive to yielding a stable easy-to-control self-oscillating inverter-type ballast; whereas the series-resonant type, although potentially simpler and more efficient, is harder to control in that it has a natural tendency to self-destruct in case the lamp load be removed.

To mitigate this tendency to self-destruct under no-load conditions, various protection circuits have been developed, such as for instance described in U.S. Pat. No. 4,638,562 to Nilssen.

General Purpose of Present Invention

The general purpose of the present invention is that of providing for a series-excited parallel-loaded ballast circuit particularly suited to power neon lamps.

SUMMARY OF THE INVENTION

Objects of the Invention

An object of the present invention is the provision of a cost-effective means for ballasting neon and other gas discharge lamps.

This as well as other objects, features and advantages of the present invention will become apparent from the following description and claims.

Brief Description

A power-line-operated frequency-converting power supply provides a 30 kHz current-limited AC voltage at an output receptacle. A neon lamp is connected across the secondary winding of a gapped ferrite-type leakage transformer, the primary winding of which is connected with the output receptacle by way of a light-weight cord, thereby permitting the lamp-transformer combination to be located remotely from the power supply. The secondary winding is arranged to have a well defined inductance; which inductance is tuned to resonate at 30 Khz by way of a parallel-connected tank capacitor. Tightly coupled with the secondary winding is a control winding with which is connected a voltage-limiting means and a protection circuit operative to place an auxiliary capacitor across the control winding in case the neon lamp were to fail to ignite within a few milli-seconds, thereby detuning the secondary winding enough to protect the power supply, the leakage transformer and other components from sustained overload.

To compensate for a difference in tuning between the situation where the secondary is loaded with nothing but the voltage-limiting means versus when it is loaded with the neon lamp, means is provided by which the effective capacitance of the tank capacitor is reduced after the neon lamp has ignited.

DESCRIPTION OF THE PREFERRED EMBODIMENT

Details of Construction

Figure 1:
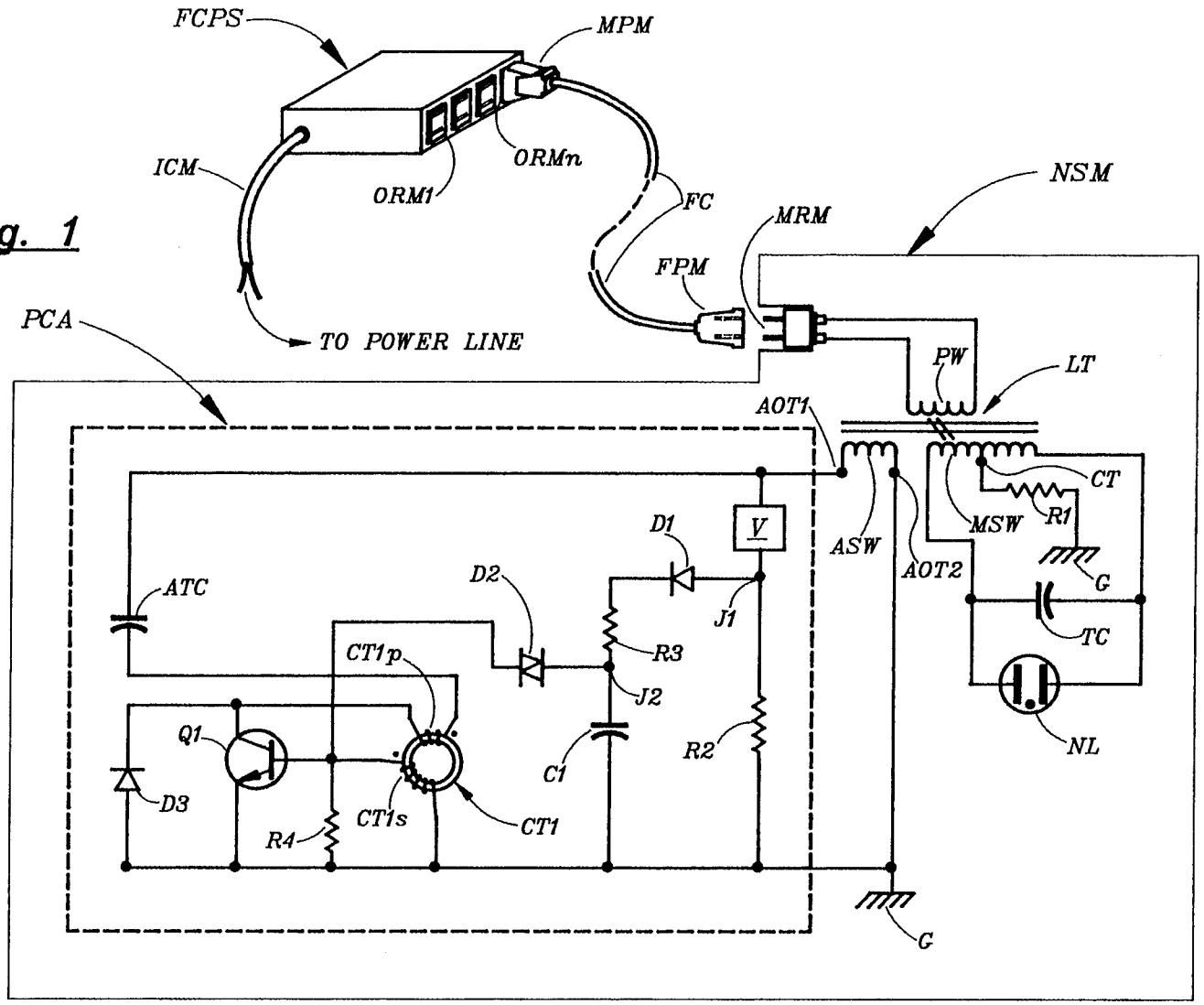
FIG. 1 diagrammatically illustrates the circuit arrangement of the invention in its preferred embodiment.

FIG. 1 schematically illustrates the preferred embodiment of the invention in its most basic form.

In FIG. 1, a frequency-converting power supply FCPS is connected with an ordinary electric utility power line by way of input conductor means ICM and has plural individual output receptacle means ORM1 . . . ORMn. Plugged into output receptacle means ORMn is a male plug means MPM to which is connected a two-conductor flexible cord FC. At the other end of this flexible cord is connected a female plug means FPM; which female plug means is plugged into a male receptacle means MRM mounted on a neon sign means NSM.

Receptacle means MRM is connected with a primary winding PW of a leakage transformer LT; which transformer has a main secondary winding MSW with a center-tap CT connected to ground G by way of resistor R1. Connected across the main secondary winding is a tank capacitor TC and a neon lamp NL.

Leakage transformer LT also has an auxiliary secondary winding ASW; which auxiliary secondary winding is tightly coupled with the main secondary winding MSW. Also, auxiliary secondary winding ASW has two auxiliary output terminals AOT1 and AOT2, with terminal AOT2 being connected with ground G.

Connected between auxiliary output terminal AOT1 and a junction J1 is a Varistor V; and between junction J1 and ground G is connected a resistor R2. The anode of a diode D1 is connected with junction J1; and a resistor R3 is connected between the cathode of diode D1 and a junction J2. A capacitor C1 is connected between junction J2 and ground G; and a Diac D2 is connected between junction J2 and the base of a transistor Q1. A resistor R4 is connected between the base of transistor Q1 and ground G.

The emitter and collector of transistor Q1 are respectively connected with ground G and the cathode of a diode D3. The anode of diode D3 is connected with ground G. A current transformer CT1 has a secondary winding CT1s connected between the base and emitter of transistor Q1. A series-combination of an auxiliary tank capacitor ATC and a primary winding CT1p of current transformer CT1 is connected between auxiliary output terminals AOT1 and the cathode of diode D3.

The assembly consisting of elements V, R2, D1, R3, C1, D2, CT1, R4, Q1, D3 and ATC is referred-to as protection circuit assembly PCA.

Figure 2:
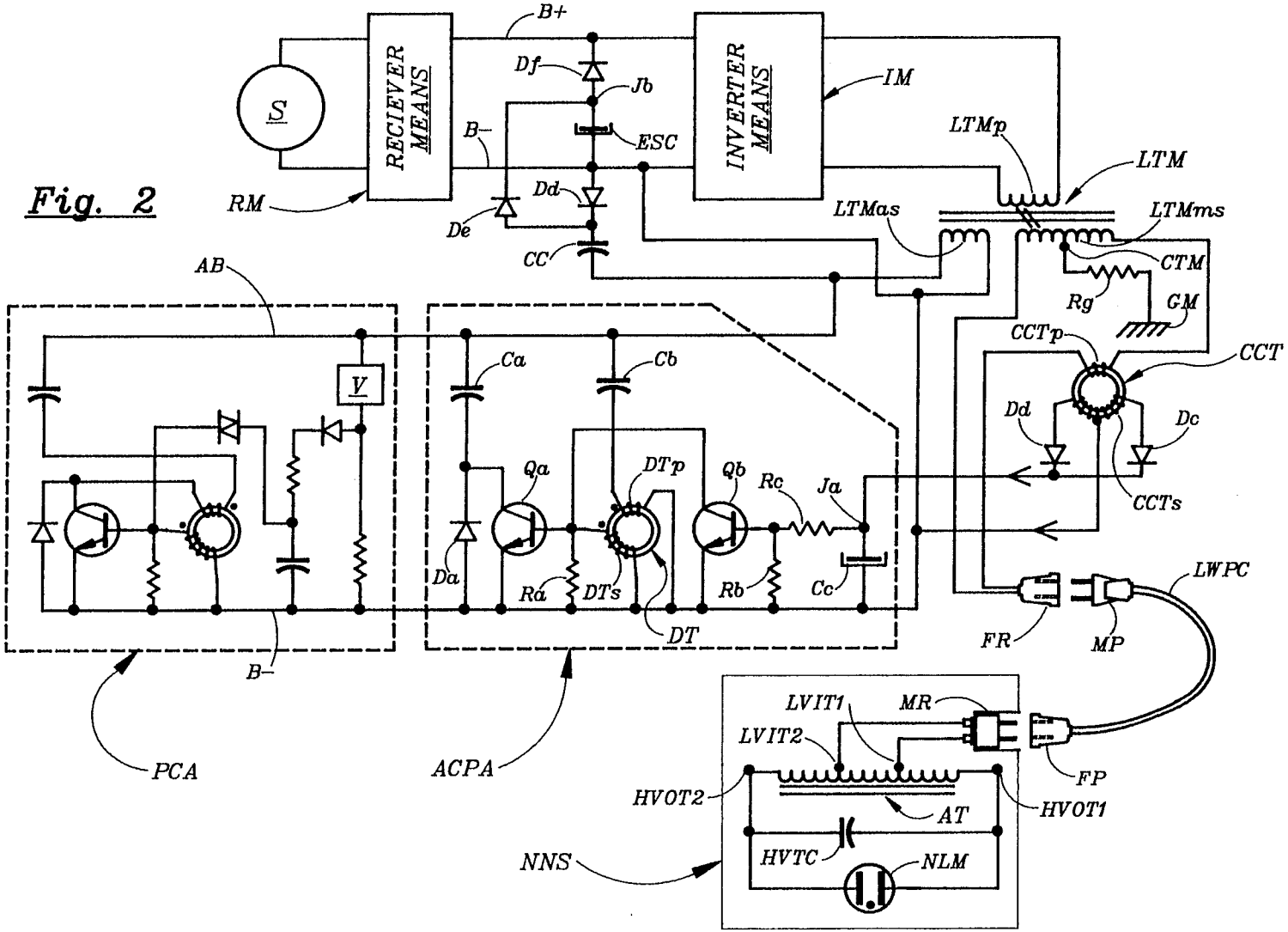
FIG. 2 illustrates an alternative embodiment of the invention.

FIG. 2 schematically illustrates a different embodiment of the invention. In FIG. 2, a rectifier means RM is powered from an AC powerline source S, and provides a DC voltage between a B+ bus and a B− bus; which DC voltage is supplied to an inverter means IM operative to provide a 30 kHz substantially non-current-limited squarewave voltage to a primary winding LTMp of a leakage transformer means LTM; which leakage transformer means LTM has a main secondary winding LTMms with a center-tap means CTM connected with a ground means GM by way of a resistor Rg. A female receptacle FR is connected with the output of main secondary winding LTMms by way of a primary winding CCTp of a current control transformer CCT.

A light-weight power cord LWPC has a male plug MP plugged into female receptacle FR and a female plug FP plugged into a male receptacle MR mounted on a neon sign structure NSS. Male receptacle MR is connected with auto-transformer AT by way of low-voltage input terminals LVIT1 and LVIT2. A high-voltage tank capacitor HVTC and a neon lamp means NLM are both connected between high-voltage output terminals HVOT1 and HVOT2 of auto-transformer AT.

Leakage transformer means LTM has an auxiliary secondary winding LTMas that is tightly coupled with main secondary winding LTMms. One of the output terminals of auxiliary secondary winding LTMas is connected with the B− bus; the other output terminal is connected with an auxiliary bus AB.

Between the B− bus and auxiliary bus AB is connected a protection circuit assembly PCA substantially identical to that identified in connection with FIG. 1.

Also connected between the B− bus and auxiliary bus AB is an auxiliary protection circuit assembly ACPA; which assembly consists of: i) a capacitor Ca connected between auxiliary bus AB and the cathode of a diode Da, whose anode is connected with the B− bus; ii) a transistor Qa connected with its collector to the cathode of diode Da and with its emitter to the B= bus; iii) a resistor Ra connected between the base of transistor Qa and the B− bus; iv) a secondary winding DTs of a drive transformer DT connected across resistor Ra; v) a capacitor Cb connected between auxiliary bus AB and the B− bus by way of a primary winding DTp of drive transformer DT; vi) a transistor Qb connected with its collector to the base of transistor Qa and with its emitter to the B− bus; vii) a resistor Rb connected between the base of transistor Qb and the B− bus; viii) a resistor Rc connected between the base of transistor Qb and a junction Ja; and ix) a filter capacitor Cc connected between junction Ja and the B− bus.

Connected with junction Ja are the cathodes of diodes Db and Dc, whose anodes are connected with secondary winding CCTs of current control transformer CCT; which secondary winding has a center-tap connected with the B− bus.

A charging capacitor CC is connected between auxiliary bus AB and the cathode of a diode Dd, whose anode is connected with the B− bus. Another diode De is connected with its anode to the the cathode of diode Dd and with its cathode to a junction Jb. An energy-storing capacitor ESC is connected between junction Jb and the B− bus; and a diode Df is connected with its anode to junction Jb and with its cathode to the B+ bus.

Details of Operation

In FIG. 1, frequency-converting power supply FCPS is of conventional design and provides a substantially non-power-limited 120 Volt/30 kHz voltage at each of the plural output receptacles ORM1 . . . ORMn.

Located some distance away from power supply FCPS is neon sign means NSM.

The neon sign means is powered by way of a substantially ordinary 120 Volt power cord; which power cord is plugged into one of the output receptacles of the power supply at its one end, and into a recessed receptacle means on the neon sign means at its other end.

When the 120 Volt/30 kHz voltage is applied to the primary winding of leakage transformer LT, a high-magnitude 30 kHz output voltage results at the output of main secondary winding MSW. The exact magnitude of this output voltage is determined by the loading connected to this secondary winding. With no loading at all, the magnitude of this output voltage is about two kilo-Volt. With tank capacitor TC as the only loading, the magnitude of the output voltage—if not limited by other means—would be exceedingly high. In particular, since the tank capacitor is chosen such as to resonate with the leakage inductance at about 30 kHz, the resulting magnitude of the output voltage would be determined by the Q-multiplication factor. With a Q-factor of 100 or so, which is indeed the approximate value of the Q-factor under normal operating conditions, the magnitude of the output voltage would reach 200 kilo-Volt or so if no breakdown or non-linearity were to occur.

However, breakdowns and non-linearities would indeed occur; and to prevent the magnitude of the output voltage from exceeding destructive levels, a voltage-limiting Varistor is effectively connected in parallel with tank capacitor TC.

This Varistor is operative to limit the magnitude of the voltage developing across the secondary winding to about 6 kilo-Volt, which is adequate to ignite neon lamp NL. After the neon ignites, the magnitude of the voltage across the secondary winding drops to a level of about 3 kilo-Volt; which voltage-magnitude is effectively established by the operating characteristics of the neon lamp.

The Varistor in not connected directly across the secondary winding. Rather, it is connected across auxiliary secondary winding ASW. However, since this auxiliary secondary winding is tightly coupled with the main secondary winding, the net result is that the Varistor is effectively connected across the main secondary winding. Yet, because it is in fact connected across a separate winding, the voltage rating of the Varistor can be substantially lower than the 6 kilo-Volt of the main secondary winding.

In fact, the Varistor is so chosen as to limit the voltage appearing across the auxiliary secondary winding to about 150 Volt peak; which, to provide for a limit of 6 kilo-Volt on the output voltage at the main secondary winding, implies that the turns-ratio between the main secondary winding and the auxiliary secondary winding is about 40:1.

The magnitude of the 30 kHz current provided to the neon lamp is about 30 milli-Ampere; which, with a 3 kilo-Volt lamp voltage, implies a lamp power level of about 90 Watt.

Because of the tuning effect of the tank capacitor interacting with the leakage inductance, the waveshape of the lamp voltage is substantially sinusoidal, as is also the waveshape of the lamp current.

When provided with a starting voltage of 3 kilo-Volt, the neon lamp ignites within a few milli-seconds; which implies that the Varistor will have to perform its voltage-limiting function only for those few milli-seconds. However, during these few milli-seconds the power dissipation in the Varistor is nearly 200 Watt; which, in 10 milli-seconds, will have amounted to a cumulated energy dissipation of only 2 Joule or so, well within the rating of an ordinary low cost Varistor.

However, if the neon lamp were to fail to ignite, or if it were to be disconnected, the Varistor might be subjected to a 200 Watt power dissipation for an indefinite period of time; which would rapidly lead to a totally unacceptable situation.

To prevent such a situation from ever occuring, an added protection feature is provided.

If the neon lamp were to fail to ignite, auxiliary tank capacitor ATC will automatically be connected across the auxiliary secondary winding, thereby detuning or altogether eliminating the resonant interaction between tank capacitor TC and the leakage inductance of the main secondary winding. This detuning results in a substantial drop in the magnitude of the output voltage across the main secondary winding, thereby substantially eliminating wasted power in addition to eliminating any possibilities for destructive overload. In fact, by making the capacitance value of auxiliary tank capacitor ATC fairly large, an effective short circuit is placed across the main secondary winding whenever this auxiliary tank capacitor is indeed connected thereacross. However, the short circuit current then resulting is not of substantially higher magnitude than that of the current flowing out of the main secondary winding under its normal load condition.

The auxiliary tank capacitor is effectively connected across the auxiliary secondary winding whenever transistor Q1 is caused to conduct; which transistor Q1 may be triggered into conduction by way of receiving a brief pulse at its base. After having been triggered into conduction, transistor Q1 will continue to conduct by way of positive current feedback provided via current transformer CT1.

A pulse to initiate conduction in transistor Q1 results when the magnitude of the voltage on capacitor C1 has become high enough to cause Diac D2 to break down. Capacitor C1 will be charged due to the voltage developing across resistor R2 as a result of clamping current flowing through varistor V. The resistance value of R2 is chosen such as to make the peak voltage across R2 somewhat higher than the (25 Volt) breakdown voltage of Diac D2. The length of time it takes for capacitor C2 to reach a magnitude high enough to cause Diac breakdown is determined by the resistance value of resistor R3; which resistance value is chosen such as to make this length of time equal to about 10 milli-seconds.

Thus, in overview, the circuit arrangement of FIG. 1 functions as follows.

(1) When neon sign means NSM is initially connected with the 120 Volt/30 kHz voltage provided by power supply FCPS, a 6 kV/30 kHz output voltage immediately develops across the output of the main secondary winding, this magnitude being manifestly determined by the voltage-limiting characteristics of the Varistor.

(2) If a functioning neon lamp is indeed connected across this main secondary winding, it will ignite within a few milli-seconds; after which point the magnitude of the 30 kHz output voltage will decrease to about 3 kilo-Volt, which is the voltage magnitude required to properly power the neon lamp.

(3) If a functioning neon lamp is not connected across the main secondary winding, after about 10 milli-seconds, a pulse will be provided to transistor Q1; thereby causing auxiliary tank capacitor ATC to be connected across the auxiliary secondary winding; thereby, in turn, causing the magnitude of the 30 kHz output voltage present across the main secondary winding to drop to but a few hundred Volt; at which magnitude level it will remain until neon sign means NSM is disconnected from its power supply FCPS.

The circuit arrangement of FIG. 2 operates in a manner that is fundamentally equal to that of the circuit arrangement of FIG. 1, except as follows.

In FIG. 2, the power supply is characterized by having a rectifier means and an inverter means, between which is positioned an energy-storing capacitor. By power feedback from the output of the inverter, this energy-storing capacitor is maintained at a voltage of magnitude equal to about half the peak magnitude of the full-wave-rectified power line voltage. That way, whenever the instantaneous absolute magnitude of the power line voltage is lower than about half of its absolute peak magnitude, current to the inverter means will be provided by energy-storing capacitor ESC; otherwise, it will be provided directly from the power line. As a result, the power factor associated with the power drawn by the power supply from the power line will be relatively high; yet the crest factor of the current provided to the neon lamp means will be relatively low.

The output of the inverter will be an amplitude-modulated 30 kHz squarewave; which 30 kHz squarewave is applied to the primary winding of leakage transformer means LTM. The final output of the power supply is actually that which is provided at the output terminals of main secondary winding LTMms; which output is a 30 kHz AC voltage with an open circuit (i.e., unloaded) voltage manifestly limited in maximum magnitude to about 100 Volt and a short circuit current that is manifestly limited in magnitude to about 1.5 Ampere. Thus, the output provided at female receptacle FR meets the requirements for Class-3 circuits in accordance with the National Electrical Code.

By way of light-weight flexible power cord LWPC, the output of the power supply is connected to male receptacle MR of neon sign structure NSS; which neon sign structure would typically be placed in a window, while the power supply would typically be placed on a wall near the window.

Because of the Class-3 nature of the power supply output, power cord LWPC can be particularly light and flexible; and this light-weight flexible power cord is all that is needed to provide for the requisite electrical connection between the power supply and the neon sign structure.

Within the neon sign structure is a 60:1 step-up autotransformer, the function of which is merely that of transforming the "impedance" level (i.e., voltage/current level) of the neon lamp means and its associated tank capacitor HVTC such as to make it compatible with the output of the power supply and to tune with the leakage inductance of main secondary winding LTMms.

Since current-limiting is already provided for by way of transformer LTM in the power supply, there is no need for auto-transformer AT to be a leakage transformer.

Auxiliary secondary winding LTMas is tightly coupled with main secondary winding LTMms and functions in a manner similar to that of auxiliary secondary winding ASW of FIG. 1. However, an additional feature has been provided in the form of auxiliary protection circuit assembly APCA.

Circuit assembly APCA functions in such manner as to cause a capacitor Ca to be effectively connected across main secondary winding LTMms, thereby effectively being added to the effective capacitance value of high-voltage tank capacitor HVTC as it is reflected across the main secondary winding. Capacitor Ca is connected across the auxiliary secondary winding by virtue of the action of transistor Qa in combination with its shunting diode Da; which transistor is maintained in a conductive state by current provided through capacitor Cb and thereby into the base of Qa via drive transformer DT. However, after a period of about 25 milliseconds, current flowing from the output of the power supply will (by way of control current transformer CCT, rectifiers Db and Dc, filter capacitor Cc, and resistor Rc) cause transistor Qb to become conductive; which, in turn, will short the base-emitter junction of transistor Qa, thereby rendering it non-conductive; thereby, in turn, disconnecting capacitor Ca from the auxiliary secondary output winding.

Thus, about 15 milli-seconds after the neon lamp means ignites, the effective tuning of the circuit changes in such a manner as to increase its natural resonance frequency.

The reason for effecting this increase in the natural resonance frequency relates to a characteristic associated with series-excited parallel-loaded resonant L-C circuits; which characteristic is related to the fact that the natural resonance frequency is a function of the effective resistance value of the parallel-connected load. If an L-C circuit is tuned to exact resonance with a very high-resistance parallel-connected load, then the L-C circuit will be tuned to below resonance when the parallel-connected load is reduced in resistance.

To provide for effective ignition of the neon lamp means, it is important that the L-C circuit consisting of the leakage inductance of the main secondary winding LTMms and the effective capacitance resulting from the parallel-connection of HVTC, Ca, and Cb be close to natural resonance at 30 kHz when the L-C circuit is loaded with nothing but voltage-limiting means V. However, as soon as the neon lamp means ignites, the effective parallel-connected load decreases significantly in resistance value, which therefore causes the L-C circuit to become detuned. To correct this detuning, the effective capacitance connected with the leakage inductance is reduced by automatically disconnecting Ca.

Thus, in overview, the circuit arrangement of FIG. 2 functions as follows.

(1) When neon sign structure NSS is initially connected with the 30 kHz voltage provided at female receptacle FR, a 6000 Volt/30 kHz voltage immediately develops across the neon lamp means; which magnitude is determined by the voltage-limiting characteristics of the Varistor. At this point, the leakage inductance of winding LTMms is tuned to resonance at 30 kHz by the combined action of capacitors HVTC, Ca, and Cb.

(2) The neon lamp means will ignite within a few milliseconds; after which point the magnitude of the 30 kHz lamp voltage will decrease to about 3000 Volt; which magnitude is determined by the operating charactistics of the neon lamp means. At this point, due to the substantial reduction in the effective resistance of the parallel-connected load, the leakage inductance of the main secondary winding LTMms becomes tuned to a frequency somewhat below 30 kHz.

(3) However, the current flowing from the output of the power supply (i.e., from female receptacle FR) will within about 25 milli-seconds cause capacitor Ca to become disconnected; whereafter the leakage inductance will be tuned with capacitors HVTC and Cb only. With the capacitance value of capacitor Ca properly chosen, the result is that the leakage inductance will again be tuned to resonance at 30 kHz.

In other words, the removal of capacitor Ca from the parallel-loaded L-C circuit is just enough to compensate for the de-tuning resulting from the reduction in the parallel-connected load resistance that resulted from the ignition of the neon lamp means.

(4) During normal operation, the 30 kHz voltage present across main secondary winding LTMms will be substantially sinusoidal in waveform, as will therefore the 30 kHz voltage present across auxiliary secondary winding LTMas as well. Energy-storing capacitor ESC gets charged from the sinusoidal output of this auxiliary secondary winding; and the magnitude of the charging current is determined by the capacitance value of charging capacitor CC; which magnitude is so chosen as to cause the voltage on capacitor ESC to become established at about 84 Volt, which is about half of the peak magnitude of the full-wave-rectified 120 Volt/60 Hz power line voltage.

(5) If the neon lamp means were to fail to ignite, the circuit of FIG. 2 would function in the same manner as that of FIG. 1: protection circuit assembly PCA would act to place a low-impedance capacitor means in effective parallel circuit with main tank capacitor HVTC.

Additional Comments (a) Article 725 of the National Electrical Code, which relates to Class-1, Class-2 and Class-3 electrical circuits, is herewith by reference made part of this application. The National Electrical Code is published by National Fire Protection Association, Batterymarch Park, Quincy, MA 02269.

(b) Class-2 and Class-3 circuits are both considered safe from fire initiation hazard. In addition, Class-2 circuits are also considered safe from electric shock hazard. Thus, wiring from a power supply with a Class-2 or Class-3 power-limited output can be sized, located and/or mounted substantially without concern for fire initiation hazard; which implies significant simplication in the way wiring is placed and used. Moreover, due to the skin effect associated with 30 kHz voltage, the electric shock hazard associated with 120 Volt/30 kHz does not appear to be more severe than that associated with 30 Volt/60 Hz, which presently is the maximum voltage permitted under Class-2 specifications. This implies that the circuit of FIG. 2 will functionally comply with Class-2 specifications as well.

However, until the relative shock hazard safety advantage of 30 kHz versus 60 Hz is officially recognized, the circuit arrangement of FIG. 2 can readily be modified to meet with current Class-2 specifications, thereby permitting particularly easy and safe installation and use of the neon sign system therein described.

(c) A leakage transformer is defined as a transformer wherein the magnetic coupling between the primary winding and the secondary winding is "substantially" less than 100%. Thus, even if the primary winding of a leakage transformer is connected to a zero-impedance voltage source, the output impedance of its secondary winding will be substantial. In fact, it will be the leakage inductance as manifested on the secondary side.

A consequence of placing a short circuit across the secondary winding of a leakage transformer is that this short circuit will not be fully reflected to the primary winding. Rather, the effect on the primary winding will be that of seeing an inductive reactance, i.e., the leakage inductance as manifested on the primary side.

(d) Due to the significant skin effect associated with 30 kHz current, the high-voltage current-limited output of auto-transformer AT of FIG. 2 (or of leakage transformer LT of FIG. 1) may be considered safe from electric shock hazard. This is so for the reason that the magnitude of available current is limited to about 30 milli-Ampere; and 30 milli-Ampere at 30 kHz does not convey any higher shock hazard than does 5 milli-Ampere at 60 Hz; yet, under current specifications, the National Electrical Code (as well as Underwriters Laboratories) accepts 5 milli-Ampere at 60 Hz as being safe from electric shock hazard.

I claim:

1. A power supply for a neon lamp, comprising:

a source of input AC voltage;

leakage transformer means having: i) an input winding connected with the input AC voltage; and ii) an output winding having a pair of output terminals; the output winding being relatively loosely coupled with the input winding, thereby manifestly exhibiting an output inductance; the output terminals, when unloaded, providing an open circuit output AC voltage;

a tank capacitor effectively connected across the output terminals; the tank capacitor being in resonance with the output inductance at the fundamental frequency of the input AC voltage, thereby causing a Q-multiplied output AC voltage to develop across the output terminals; the magnitude of the Q-multiplied output AC voltage being substantially larger than that of the open circuit output AC voltage; and neon lamp means effectively connected across the output terminals, the magnitude of the Q-multiplied output AC voltage being sufficient to cause the neon lamp means to ignite.

2. The power supply of claim 1 wherein the input AC voltage is characterized by being substantially a square-wave voltage.

3. The power supply of claim 1 wherein the frequency of the AC voltage is substantially higher than that of the voltage on an ordinary electric utility power line.

4. The power supply of claim 3 wherein the source of input AC voltage comprises frequency-conversion means connected with an ordinary electric utility power line and operative to provide said input AC voltage.

5. The power supply of claim 3 wherein the magnitude of the Q-multiplied AC voltage substantially exceeds 1000 Volt.

6. The power supply of claim 1 wherein the leakage transformer has a control winding that is relatively tightly coupled with the output winding; an over-voltage protection means being connected with the control winding and operative to cause a substantial reduction in the magnitude of the Q-multiplied AC voltage after a brief period of time in case the neon lamp means were to fail to ignite within such brief period of time.

7. The power supply of claim 6 wherein said substantial reduction is accomplished by way of causing a capacitive impedance means to be placed across the control winding.

8. The power supply of claim 7 wherein the capacitance of the capacitive impedance means is so large as to cause its placement across the control winding to substantially constitute a short circuit across the control winding and thereby across the output terminals.

9. The power supply of claim 1 wherein a voltage-limiting means is effectively connected in parallel with the tank capacitor.

10. The power supply of claim 1 wherein: i) an auxiliary capacitor means is effectively connected in parallel circuit with the tank capacitor; ii) a control means is connected in circuit with the tank capacitor and the auxiliary capacitor means; and iii) the control means is operative to disconnect the auxiliary capacitor means after the neon lamp means has ignited.

11. The power supply of claim 1 wherein the magnitude of the input AC voltage in substantially independent of the magnitude of any current drawn from the source.

12. An arrangement comprising:

a source of input AC voltage;

transformer means having a primary winding connected with the input AC voltage; the transformer means having a secondary winding with a pair of output terminals across which is provided an output AC voltage having a magnitude; the secondary winding being relatively loosely coupled with the primary winding, thereby to establish a situation where the output terminals exhibit a manifest output impedance; which output impedance effectively constitutes an inductive reactance;

main capacitor means effectively connected across the output terminals; the main capacitor means having a capacitive reactance which, at the frequency of the out put AC voltage, is resonant with the inductive reactance, thereby via resonance action to cause the magnitude to be substantially larger than it would have been in the absence of the main capacitor means; and neon lamp means effectively connected in parallel with the main capacitor means.

13. The arrangement of claim 12 wherein: i) an output current is drawn from the output terminals; ii) the magnitude of the output AC voltage is dependent upon the parameters of the output current; iii) the magnitude of the output AC voltage is relatively high before the neon lamp means has ignited, this relatively high magnitude being adequate to cause ignition of the neon lamp means; iv) the magnitude of the output AC voltage is relatively low after the neon lamp means has ignited; and v) a safety means is connected in circuit with the secondary winding, which safety means is operative, if the neon lamp means were to fail to ignite, to cause the magnitude of the output AC voltage to be reduced to a magnitude substantially lower than said relatively high magnitude.

14. The arrangement of claim 12 additionally comprising auxiliary capacitor means disconnectably connected in parallel circuit with the main capacitor means; the auxiliary capacitor means being automatically disconnected after the neon lamp means has ignited.

15. The arrangement of claim 12 with protection means connected in circuit with the output terminals and operative, except if the neon lamp means were to ignite within a brief period, to place a conductance means effectively across the output terminals; the conductance means being operative to draw sufficient current from the output terminals to cause the magnitude of the output AC voltage to drop to a level below that required for igniting the neon lamp means.

16. The arrangement of claim 12 additionally comprising means whereby the effective capacitance of the main capacitor means decreases as a function of decreasing magnitude of the output AC voltage, thereby to compensate for the decrease in natural resonance frequency that inherently occurs upon ignition of the neon lamp means.

17. The arrangement of claim 12 wherein the source of input AC voltage comprises frequency converter means connected with an ordinary electric utility power line and operative to cause the input AC voltage to have a fundamental frequency substantially higher than that of the voltage on this ordinary electric utility power line.

18. An arrangement comprising:

AC-to-DC conversion means connected with the power line voltage of an ordinary electric utility power line and operative to provide a DC voltage at a pair of DC output terminals; the AC-to-DC conversion means having: i) rectifier means connected with the electric utility power line and operative to provide a unidirectional current to the DC output terminals whenever the absolute instantaneous magnitude of the power line voltage is higher than that of the DC voltage; and ii) energy-storing means connected with the DC output terminals and operative to provide unidirectional current to the DC output terminals whenever the absolute instantaneous magnitude of the power line voltage is lower than that of the DC voltage;

inverter means connected with the DC terminals and operative to provide an input AC voltage;

transformer means having a primary winding connected with the input AC voltage; the transformer means having a secondary winding with a pair of AC output terminals across which is provided an output AC voltage; the secondary winding being relatively loosely coupled with the primary winding, thereby to establish a situation where the output terminals exhibit a manifest output impedance; which output impedance effectively constitutes an inductive reactance;

main capacitor means effectively connected across the AC output terminals; the main capacitor means having a capacitive reactance which, at the frequency of the output AC voltage, is resonant with the inductive reactance, thereby via resonance action to cause the magnitude of the output AC voltage to be substantially larger than it would have been in the absence of the main capacitor means; and lamp load means effectively connected across the AC output terminals.

19. The arrangement of claim 18 additionally comprising energy feedback means connected in circuit between the secondary winding and the energy-storing means; the energy feedback means being operative to charge the energy-storing means.

20. The arrangement of claim 19 wherein the energy feedback means comprises a tertiary winding tightly coupled with the secondary winding.

21. The arrangement of claim 18 additionally comprising protection means connected with the AC output terminals and operative to place an effective AC short circuit thereacross in the event that the lamp load means were to fail to draw power from the AC output terminals.

22. The arrangement of claim 18 wherein the input AC voltage may be characterized as being a square-wave voltage.

* * * * *